US008192180B2

(12) United States Patent
Horng et al.

(10) Patent No.: US 8,192,180 B2
(45) Date of Patent: Jun. 5, 2012

(54) HEAT DISSIPATING FAN

(75) Inventors: Alex Horng, Kaohsiung (TW); Tso-Kuo Yin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 322 days.

(21) Appl. No.: 12/582,030

(22) Filed: Oct. 20, 2009

(65) Prior Publication Data

US 2011/0091338 A1 Apr. 21, 2011

(51) Int. Cl.
*F04B 35/04* (2006.01)

(52) U.S. Cl. ..... 417/423.15; 417/423.14; 310/89; 310/91; 310/406; 310/407; 310/410; 310/413; 310/216.129

(58) Field of Classification Search ..... 417/354, 417/366, 370, 423.12, 423.14, 423.15; 310/89, 310/91, 406, 407, 410, 413, 414, 216.129
See application file for complete search history.

(56) References Cited

U.S. PATENT DOCUMENTS 5,767,596 A * 6/1998 Stark et al. ..... 310/89
5,939,807 A * 8/1999 Patyk et al. ..... 310/89
6,011,331 A * 1/2000 Gierer et al. ..... 310/58
6,439,862 B2 * 8/2002 Chen ..... 417/423.7
7,094,039 B2 8/2006 Hu et al.
7,234,919 B2 6/2007 Lee et al.
2007/0217149 A1 9/2007 Horng et al.

* cited by examiner

*Primary Examiner* — Devon Kramer
*Assistant Examiner* — Ryan Gatzemeyer
(74) *Attorney, Agent, or Firm* — Alan Kamrath; Kamrath IP Lawfirm, PA

(57) ABSTRACT

A heat dissipating fan includes a housing having an air inlet and an air outlet between which an air passageway is formed. A fixed seat is provided in the air passageway and includes first positioning holes. A magnetically conductive first casing includes a first outer wall, a first annular lip extending radially outward from an end of the first outer wall and having second positioning holes aligned with the first positioning holes, and a first support on the other end of the first outer wall. A second casing includes a second outer wall, a second annular lip extending radially outward from an end of the second outer wall and having third positioning holes aligned with the first positioning holes, and a second support on the other end of the second outer wall. Fasteners extend through the first, second and third positioning holes. A motor is mounted in the first and second casings.

11 Claims, 6 Drawing Sheets

HEAT DISSIPATING FAN

BACKGROUND OF THE INVENTION

1. Field of the Invention

The present invention relates to a heat dissipating fan and, more particularly, to a heat dissipating fan that can easily be processed, manufactured, and assembled.

2. Description of the Related Art

FIG. 1 shows a conventional heat dissipating fan 80 including a housing 81, a stator 82, a rotor 83, a driving device 84, and an impeller 85. The housing 81 consists of first and second housing parts 811 and 812 fixed together by fasteners 813 such as screws or rivets. The stator 82 includes a magnetically conductive element 821. The rotor 83 includes a shaft 831 and a magnetic element 832. The shaft 831 extends through the housing 81 and is rotatably supported by first and second bearings 833 and 834. The magnetic element 832 is mounted around the shaft 831 and aligned with the magnetically conductive element 821. The driving device 84 is electrically connected to the magnetically conductive element 821. The impeller 85 is coupled to the shaft 831 and located outside of the housing 81. The driving device 84 can control the direction of electric current of the magnetically conductive element 821 to magnetically interact with the magnetic element 832 for driving the rotor 83 and the impeller 85 to rotate. An example of such a heat dissipating fan is disclosed in Taiwan Patent Publication No. 200744290. However, the heat dissipating fan 80 does not include an outer casing, such that the air currents generated by rotation of the impeller 85 can not be effectively guided to the heat generating portion of the electronic product and fails to provide satisfactory heat dissipating effect.

FIG. 2 shows another conventional heat dissipating fan 90 including a housing 91, a motor 92, an impeller 93, and a circuit board 94. The housing 91 includes a housing portion 911 and a motor casing 912 that are formed of plastic material by injection molding. The motor casing 912 is located in the housing portion 911 and interconnected by connecting members 913 in the form of ribs to the housing 911. The motor 92 is mounted in the motor casing 912 and includes a shaft 921, a magnetic element 922, and a stator 923. The shaft 921 is rotatably supported by two bearings 924 and has an end extending beyond the motor casing 912. The magnetic element 922 is mounted to the shaft 921 and aligned with the stator 923. The impeller 93 is mounted to the end of the shaft 921 and located outside of the motor casing 912. The circuit board 94 is electrically connected to the stator 923. The motor 92 can drive the impeller 93 to rotate for providing heat dissipating functions. The housing 91 formed by injection molding guides the air currents generated by rotation of the impeller 93. However, the motor casing 912 of the housing 91 made of plastic material can not provide a magnetically sealing function while the stator 923 magnetically interacts with the magnetic element 922 under control of the circuit board 94. Thus, magnetic leakage is liable to occur, and electromagnetic interference occurs, leading to adverse affect to the operational effect of the impeller 93 and to the heat dissipating effect of the heat dissipating fan 90. Furthermore, it is difficult to install the magnetic element 922, the stator 923, and the circuit board 94 in the housing portion 911 and the motor casing 912, particularly when the housing 91, the motor 92, and the impeller 93 are of larger sizes. Further, it is difficult and expensive to manufacture a metal housing 91 of a larger size.

SUMMARY OF THE INVENTION

An objective of the present invention is to provide a heat dissipating fan with enhanced heat dissipating effect.

Another objective of the present invention is to provide a heat dissipating fan that is easy to process, manufacture, and assemble at low costs.

A further objective of the present invention is to provide a heat dissipating fan suitable for housings of large sizes or made of metal.

Still another objective of the present invention is to provide a heat dissipating fan that can reliably avoid magnetic leakage and electromagnetic interference.

The present invention fulfills the above objectives by providing, in a preferred form, a heat dissipating fan including a housing having an air inlet and an air outlet spaced from the air inlet in an axial direction. An air passageway is formed between the air inlet and the air outlet. A fixed seat is provided in the air passageway and interconnected to the housing. The fixed seat includes a plurality of first positioning holes extending in the axial direction. A first casing made of magnetically conductive material includes a first outer wall having first and second ends. A first annular lip extends outward from the first end of the first outer wall in a radial direction perpendicular to the axial direction. The first annular lip includes a plurality of second positioning holes aligned with the plurality of first positioning holes. A plurality of fasteners extends through the plurality of first positioning holes and the plurality of second positioning holes. A first support is located on the second end of the first outer wall. A second casing includes a second outer wall having first and second ends. A second annular lip extends outward from the first end of the second outer wall in the radial direction. The second annular lip includes a plurality of third positioning holes aligned with the plurality of first positioning holes and the plurality of second positioning holes. The plurality of fasteners extends through the plurality of third positioning holes. A second support is located on the second end of the second outer wall. A motor is mounted in the first and second casings. The motor includes a rotor, a stator, and a circuit board. The rotor includes a shaft and a magnetic element. The shaft is rotatably supported by the first and second supports. An impeller is coupled to the shaft. The magnetic element is aligned with the stator. The circuit board is electrically connected to the stator.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
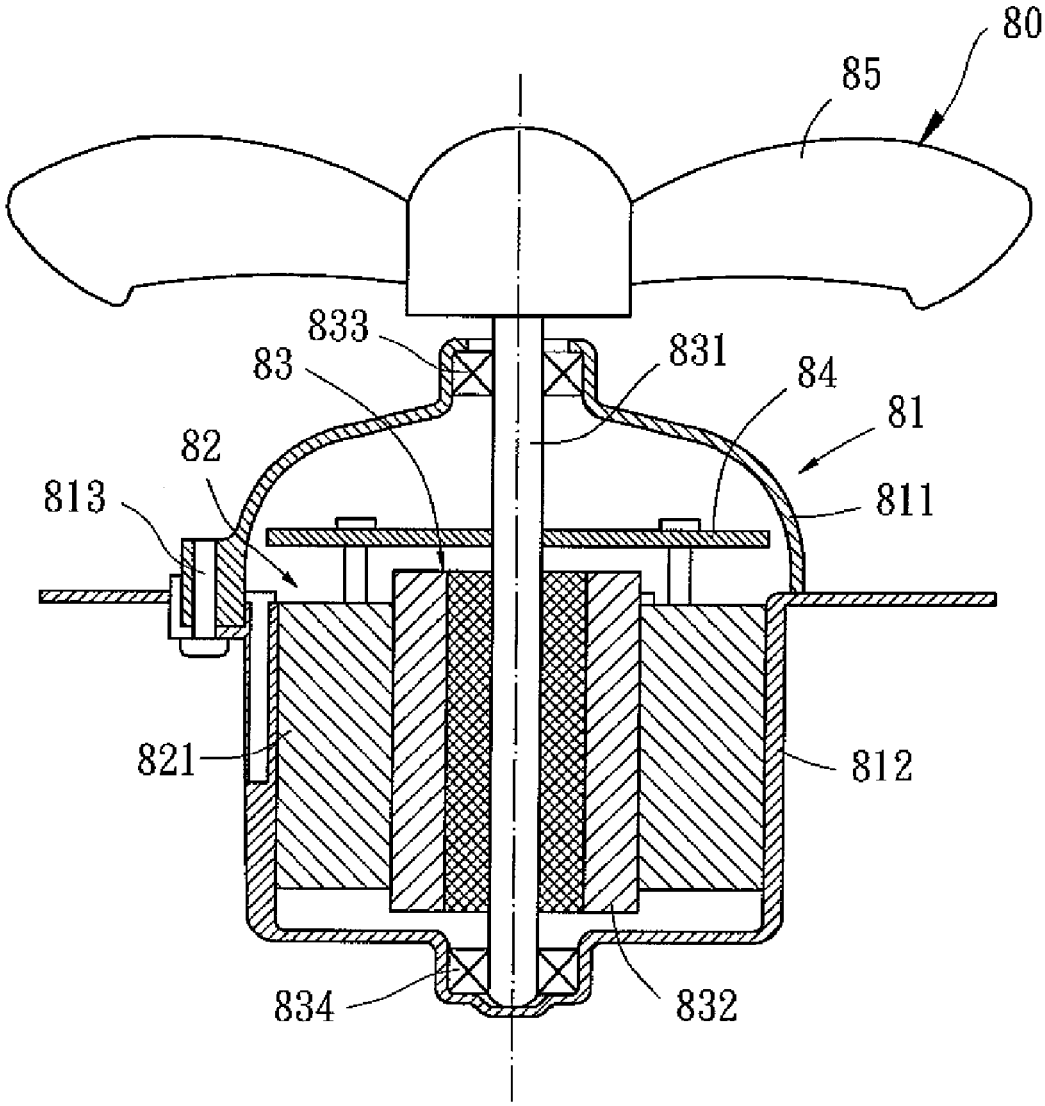
FIG. 1 PRIOR ART
FIG. 1 shows a cross sectional view of a conventional heat dissipating fan.
Figure 2:
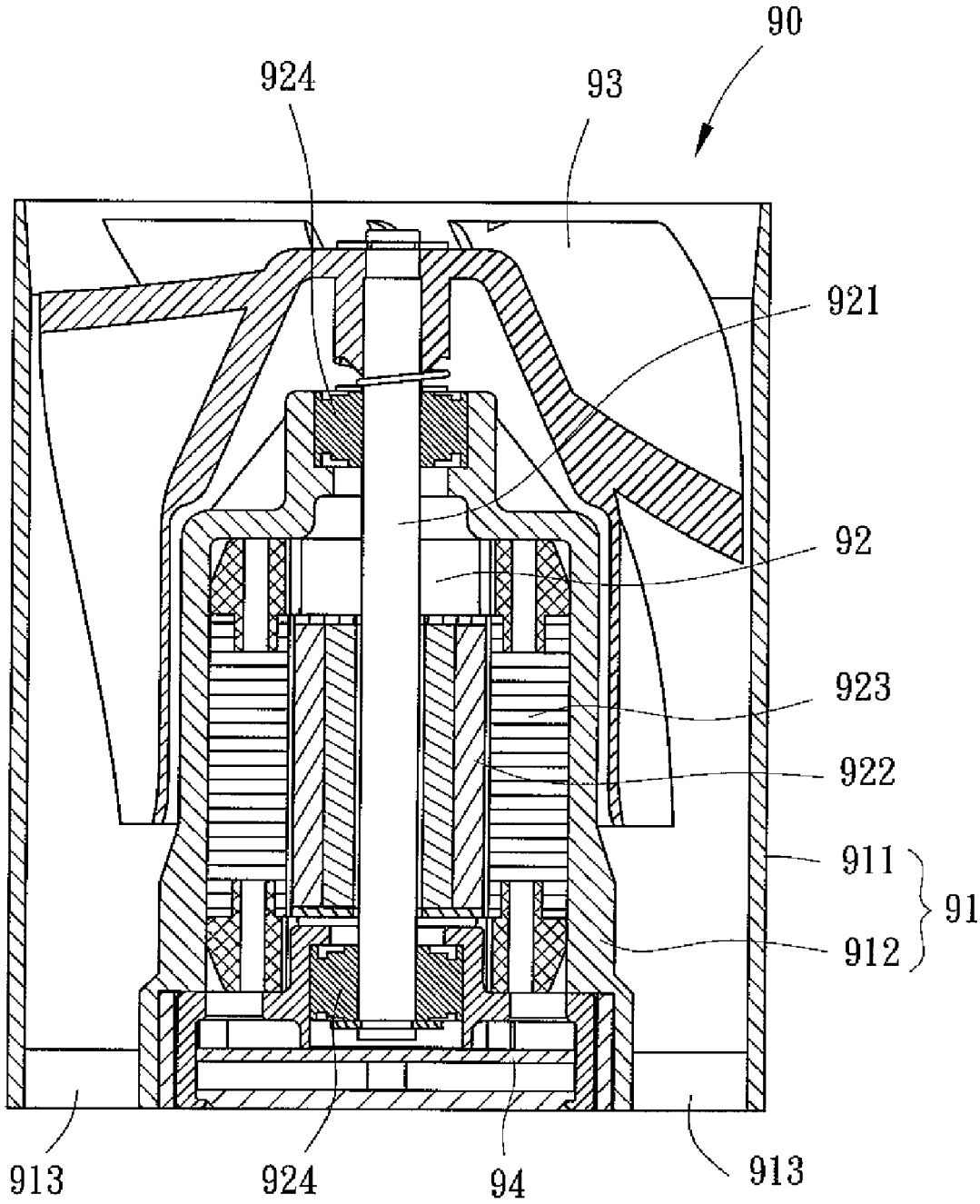
FIG. 2 PRIOR ART
FIG. 2 shows a cross sectional view of another conventional heat dissipating fan.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "lower", "inner", "outer", "end", "portion", "section", "axial", "radial", "annular", "outward", "inward", "spacing", "length", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
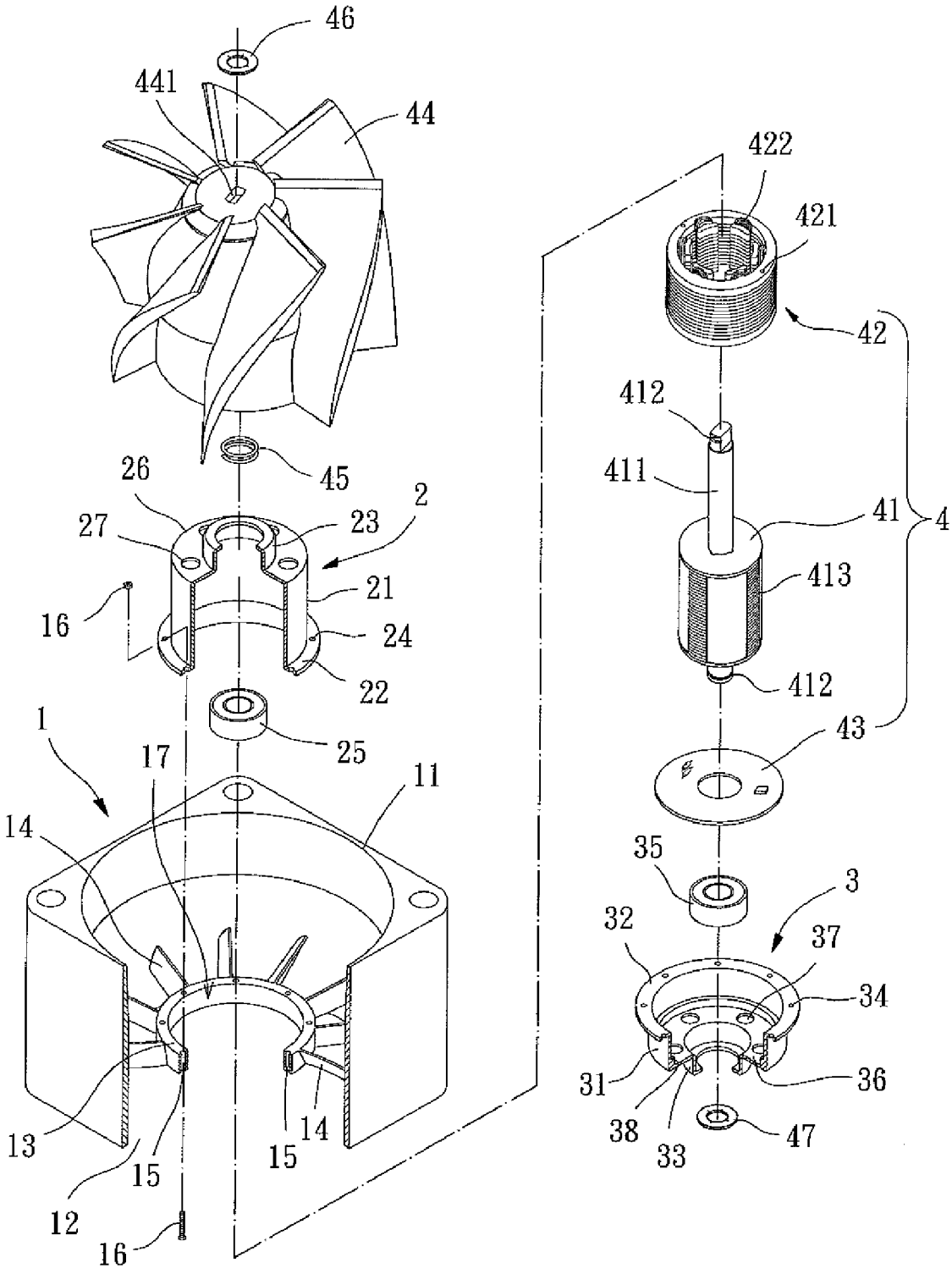
FIG. 3 shows an exploded, perspective view of a heat dissipating fan of a first embodiment according to the preferred teachings of the present invention.
Figure 4:
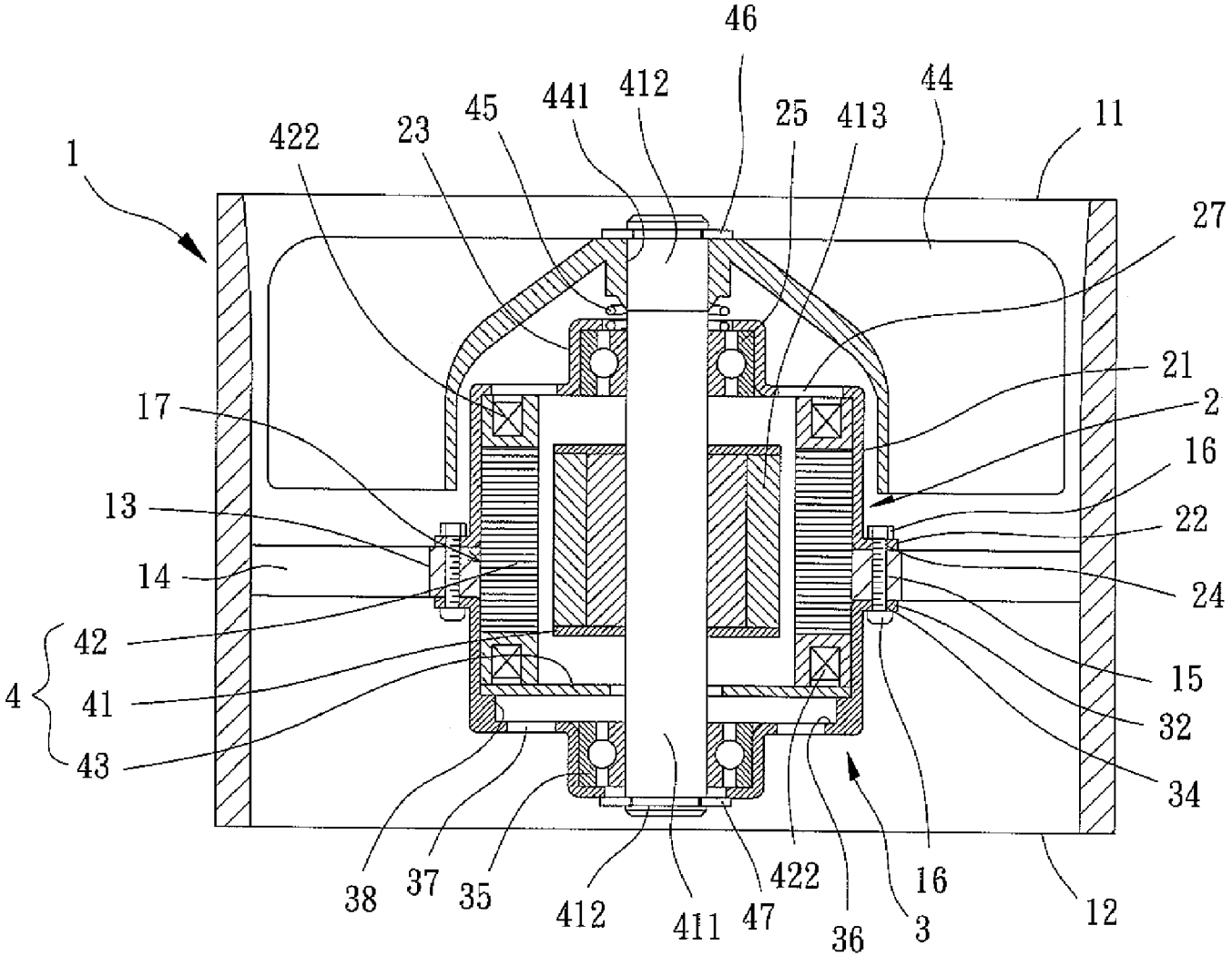
FIG. 4 shows a cross sectional view of the miniature fan of FIG. 3.

A heat dissipating fan of a first embodiment according to the preferred teachings of the present invention is shown in FIGS. 3 and 4. The heat dissipating fan includes a housing 1, a first casing 2, a second casing 3, and a motor 4. The first and second casings 2 and 3 are coupled together and mounted in the housing 1. The motor 4 is mounted in the coupled first and second casings 2 and 3. The motor 4 can drive an impeller 44 to rotate. The housing 1 concentrates and guides the air currents generated by rotation of the impeller 44.

Specifically, the housing 1 is made of plastic material or metal. The housing 1 includes an air inlet 11 and an air outlet 12 spaced from the air inlet 11 in an axial direction. An air passageway is formed between the air inlet 11 and the air outlet 12. A fixed seat 13 is provided in the air passageway and includes a through-hole 17. The fixed seat 13 is interconnected by a plurality of connecting members 14 in the form of ribs or stationary vanes to the housing 1. The fixed seat 13 has an appropriate thickness in a radial direction perpendicular to the axial direction and an appropriate length in the axial direction. Furthermore, the fixed seat 13 includes a plurality of first positioning holes 15 extending in the axial direction. A fastener 16 is extended through each first positioning hole 15 for fixing the first and second casings 2 and 3 together. In the first embodiment, each first positioning hole 15 is circular in cross section, and the fasteners 16 can include bolts and nuts.

The first casing 2 is a hollow casing made of magnetically conductive material and, preferably, made of metal by punching or milling, so that the first casing 2 has an inner periphery in the form of a true circle. The first casing 2 includes a first outer wall 21, a first annular lip 22, and a first support 23. The first annular lip 22 extends outward from a first end of the first outer wall 21 in the radial direction and includes a plurality of second positioning holes 24 aligned with the first positioning holes 15, so that the fasteners 16 can fix the first casing 2 and the housing 1 together. The first support 23 is located on a second end of the first outer wall 21 and receives and supports a first bearing 25. The first support 23 and the first outer wall 21 have different diameters to form a shoulder 26. The shoulder 26 can include a plurality of heat dissipating holes 27.

The second casing 3 is also a hollow casing made of magnetically conductive material and, preferably, made of metal by punching or milling, so that the second casing 3 has an inner periphery in the form of a true circle. Preferably, the shapes of the first and second casings 2 and 3 are identical or complementary to each other. The second casing 3 includes a second outer wall 31, a second annular lip 32, and a second support 33. The second annular lip 32 extends outward from a first end of the second outer wall 31 in the radial direction and includes a plurality of third positioning holes 34 aligned with the first and second positioning holes 15 and 24, so that the fasteners 16 can fix the first and second casings 2 and 3 and the housing 1 together. The second support 33 is located on a second end of the second outer wall 31 and receives and supports a second bearing 35. The second support 33 and the second outer wall 31 have different diameters to form a shoulder 36. The shoulder 36 can include a plurality of heat dissipating holes 37. Preferably, the second casing 3 includes a radial, annular ledge 38 formed therein.

The motor 4 is mounted in the first and second casings 2 and 3 and includes a rotor 41, a stator 42, and a circuit board 43. The rotor 41 is rotatably received in the stator 42 and includes a shaft 411 and a magnetic element 413. The shaft 411 includes first and second ends each having a coupling portion 412. The first end of the shaft 411 is extended through the first bearing 25 and coupled to the impeller 44 for driving the impeller 44 to rotate synchronously. In the preferred forms shown in FIGS. 3-6, the coupling portion 412 of the first end of the shaft 411 has non-circular cross sections and is engaged with a non-circular coupling portion 441 of the impeller 44 and retained in place by a retainer 46. If necessary, a cushioning member 45 such as a spring can be mounted around the shaft 411 to avoid the impeller 44 from pressing against the first bearing 25. The second end of the shaft 411 extends through the second bearing 35. A retainer 47 is mounted to the coupling portion 412 of the second end of the shaft 411 to prevent disengagement of the shaft 411. Thus, the shaft 411 can rotate about a common axis passing through the centers of the first and second bearings 25 and 35. The magnetic element 413 is fixed to an outer periphery of the shaft 411 and aligned with the stator 42. The stator 42 can include conventional silicon steel plates. Furthermore, the stator 42 can include a plurality of fourth positioning holes 421 and a coil portion 422. The circuit board 43 is mounted to the radial, annular ledge 38, so that a spacing exists between the circuit board 43 and the shoulder 36 of the second casing 3 to provide enhanced heat dissipating effect. The circuit board 43 is electrically connected to the stator 42.

With reference to FIG. 4, in assembly of the heat dissipating fan of the first embodiment according to the teachings of the present invention, the first bearing 25 is fixed in the first support 23 of the first casing 2, and the stator 42 of the motor 4 is mounted into the first casing 2 in a fixed position relative to the first outer wall 21. Then, the first casing 2 is mounted to the fixed seat 13 of the housing 1. Next, the second bearing 35 and the circuit board 43 are mounted into the second casing 3. Then, the first end of the shaft 411 is extended through the first bearing 25, and the second end of the shaft 411 is extended through the second bearing 35. The third positioning holes 34 are aligned with the first and second positioning holes 15 and 24. The fasteners 16 are extended through the first, second, and third positioning holes 15, 24, and 34 to fix the first and second casings 2 and 3 to the housing 1. The coupling portion 441 of the impeller 44 is coupled to the coupling portion 412 of the first end of the shaft 411. Then, the retainers 46 and 47 are mounted to the coupling portions 412 of the shaft 411 to retain the shaft 411 in place. The heat dissipating fan of the first embodiment according to the teachings of the present invention is, thus, constructed.

The housing 1 of the heat dissipating fan of the first embodiment according to the teachings of the present invention can guide the air currents driven by the impeller 44. Since the housing 1 is made of plastic material or metal, the present invention can fulfill the need of manufacturing heat dissipating fans of larger sizes while allowing easy processing and assembly of the heat dissipating fans. Furthermore, the first casing 2 made of magnetically conductive material can provide a magnetically sealing effect to avoid magnetic leakage and electromagnetic interference. Further, the manufacturing and processing methods of the first and second casings 2 and 3 allow the first and second casings 2 and 3 to be tightly and fixedly mounted to the fixed seat 13.

Figure 5:
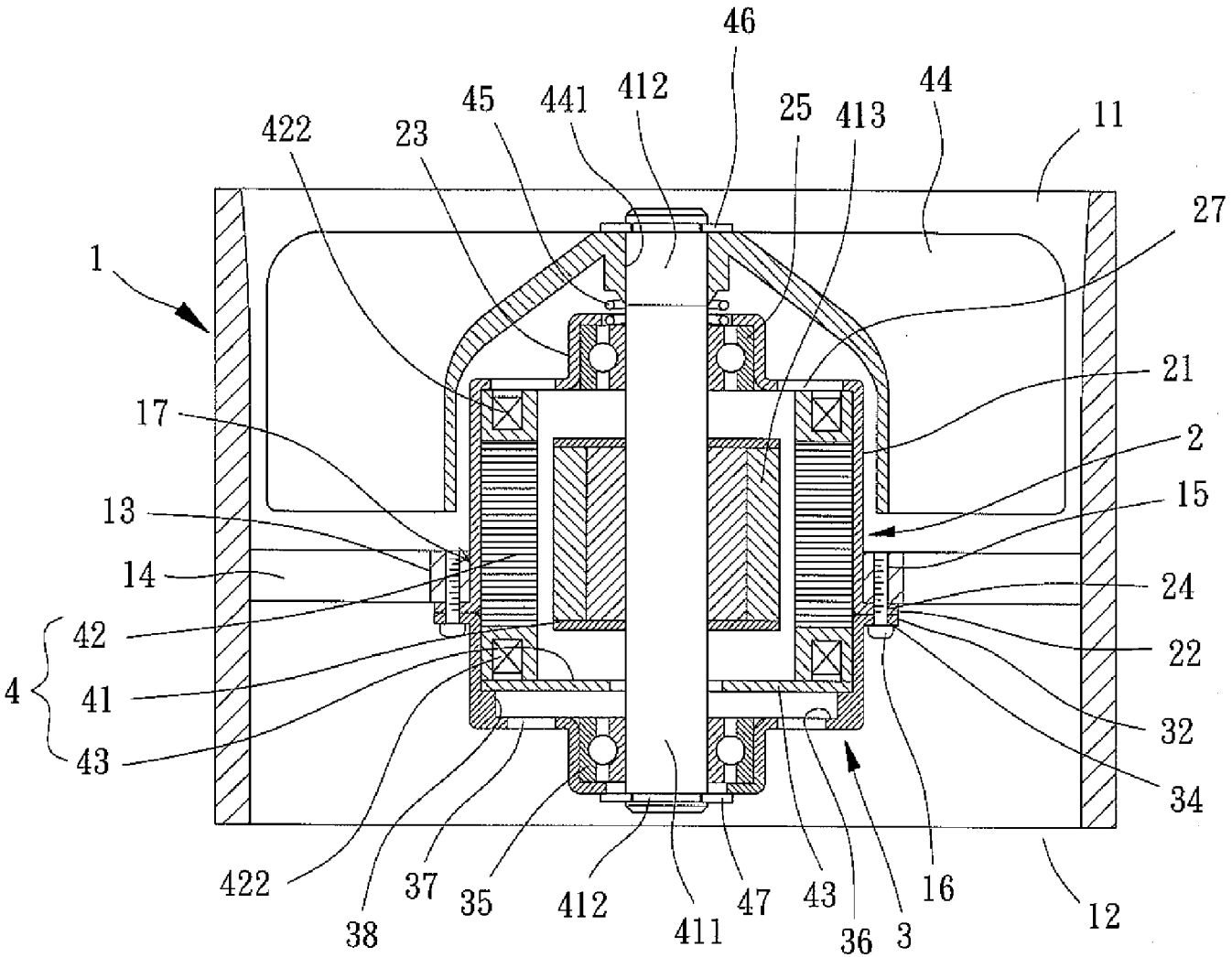
FIG. 5 shows a cross sectional view of a heat dissipating fan of a second embodiment according to the preferred teachings of the present invention.

FIG. 5 shows a heat dissipating fan of a second embodiment according to the teachings of the present invention including a housing 1, a first casing 2, a second casing 3, and a motor 4, which are substantially the same as those of the first embodiment, details of which are not described to avoid redundancy.

In the second embodiment, the first and second casings 2 and 3 and the motor 4 can be firstly assembled outside of the housing 1. Then, the first outer wall 21 of the first casing 2 or the second outer wall 31 of the second casing 3 are tightly fixed to an inner periphery of the through-hole 17, so that the first and second annular lips 22 and 32 are on the same side of the fixed seat 13. In the preferred form shown in FIG. 5, the first and second annular lips 22 and 32 are on the lower side of the fixed seat 13. However, the first and second annular lips 22 and 32 can be on the upper side of the fixed seat 13. The second positioning holes 24 already aligned with the third positioning holes 34 are aligned with the first positioning holes 15 of the housing 1. Thus, the fasteners 16 can directly fix the first and second casings 2 and 3 to the housing 1 at the same time. Then, the retainers 46 and 47 are mounted to the coupling portions 412 of the shaft 411 to retain the shaft 411 in place. The heat dissipating fan of the second embodiment according to the teachings of the present invention is, thus, constructed.

The functions and effect provided by the heat dissipating fan of the second embodiment according to the teachings of the present invention are the same as those of the heat dissipating fan of the first embodiment according to the teachings of the present invention. However, the heat dissipating fan of the second embodiment according to the teachings of the present invention can be assembled more easily.

Figure 6:
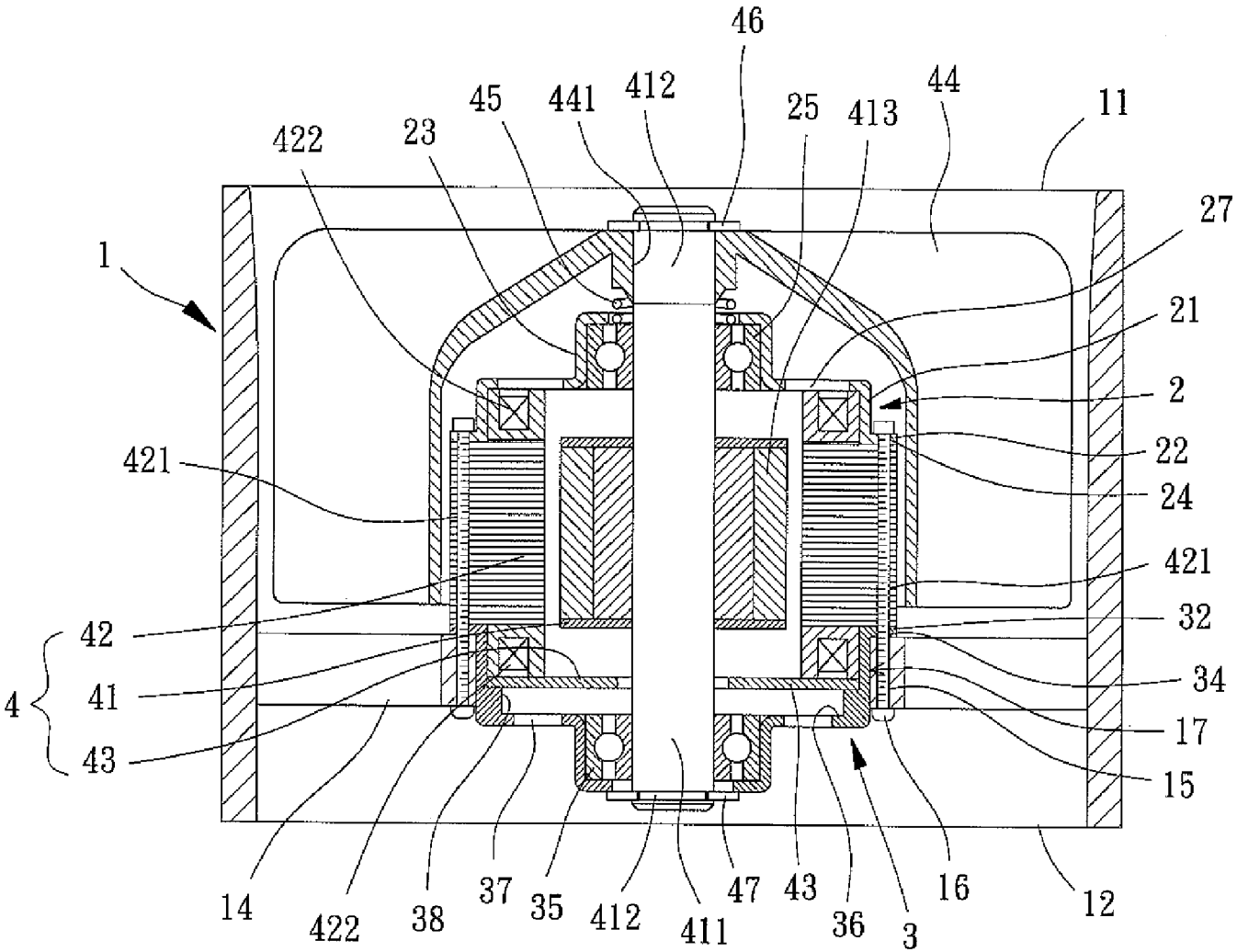
FIG. 6 shows a cross sectional view of a heat dissipating fan of a third embodiment according to the preferred teachings of the present invention.

FIG. 6 shows a heat dissipating fan of a third embodiment according to the teachings of the present invention including a housing 1, a first casing 2, a second casing 3, and a motor 4, which are substantially the same as those of the first embodiment, details of which are not described to avoid redundancy. However, it is noted that the stator 42 has a larger diameter, and the impeller 44 has a larger inner diameter for receiving the stator 42.

In assembly of the third embodiment, the second bearing 35 is mounted into the second casing 3. The second annular lip 32 of the second casing 3 is mounted to the fixed seat 13 of the housing 1. The second outer wall 31 is tightly fixed to the inner periphery of the through-hole 17 of the fixed seat 13. Then, the circuit board 43 is mounted in the second casing 3, and the stator 42 is mounted to the second annular lip 32 of the second casing 3. The first end of the shaft 411 is rotatably extended through the first bearing 25, and the impeller 44 is coupled to the first end of the shaft 411. Next, the second end of the shaft 411 is rotatably extended through the second bearing 35 of the second casing 3. The fasteners 16 are extended through the first, second, third, and fourth positioning holes 15, 24, 34, and 421. In this embodiment, each fastener 16 includes a longer bolt and a nut. Thus, the fasteners 16 can directly fix the first and second casings 2 and 3 and the stator 42 to the fixed seat 13 of the housing 1 at the same time. The heat dissipating fan of the third embodiment according to the teachings of the present invention is, thus, constructed.

The functions and effect provided by the heat dissipating fan of the third embodiment according to the teachings of the present invention are the same as those of the heat dissipating fan of the first embodiment according to the teachings of the present invention. Furthermore, the stator 42 of the heat dissipating fan of the third embodiment according to the teachings of the present invention can be fixed together with the first and second casings 2 and 3 at the same time.

Since the heat dissipating fans according to the teachings of the present invention include a housing 1 for guiding the air currents driven by the impeller 44 to flow in a predetermined direction, the heat dissipating effect is enhanced. Furthermore, since the first casing 2 and the housing 1 can be manufactured separately and then assembled easily, the manufacturing costs are cut. Further, separate manufacture of the casing 2 and the housing 1 also allows manufacture of heat dissipating fans of larger sizes or having metal housings 1. Furthermore, the first casing 2 made of magnetically conductive material can provide a magnetically sealing effect to avoid magnetic leakage and electromagnetic interference.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A heat dissipating fan comprising:

a housing including an air inlet and an air outlet spaced from the air inlet in an axial direction, with an air passageway formed between the air inlet and the air outlet, with a fixed seat provided in the air passageway, with the fixed seat interconnected by a plurality of connecting members to the housing, with the fixed seat including a plurality of first positioning holes extending in the axial direction, with the fixed seat further including a through-hole extending in the axial direction;

a first casing made of magnetically conductive material, with the first casing including a first outer wall having first and second ends, with a first annular lip extending outward from the first end of the first outer wall in a radial direction perpendicular to the axial direction, with the first annular lip including a plurality of second positioning holes aligned with the plurality of first positioning holes, with a plurality of fasteners extending through the plurality of first positioning holes and the plurality of second positioning holes with a first support located on the second end of the first outer wall;

a second casing including a second outer wall having first and second ends, with a second annular lip extending outward from the first end of the second outer wall in the radial direction, with the second annular lip including a plurality of third positioning holes aligned with the plurality of first positioning holes and the plurality of second positioning holes, with the plurality of fasteners extending through the plurality of third positioning holes, with a second support located on the second end of the second outer wall, with the first annular lip of the first casing and the second annular lip of the second casing located on a same side of the fixed seat in the axial direction; and a motor mounted in the first and second casings, with the motor including a rotor, a stator, and a circuit board, with the rotor including a shaft and a magnetic element, with the shaft rotatably supported by the first and second supports, with an impeller coupled to the shaft, with the magnetic element aligned with the stator, with the circuit board electrically connected to the stator.

2. The heat dissipating fan as claimed in claim 1, with the first support of the first casing receiving a first bearing, and with the second support of the second casing receiving a second bearing.

3. The heat dissipating fan as claimed in claim 1, with the second casing including a radial, annular ledge formed therein, and with the circuit board mounted to the radial, annular ledge.

4. The heat dissipating fan as claimed in claim 1, with the stator including a plurality of fourth positioning holes aligned with the plurality of first positioning holes, the plurality of second positioning holes, and the plurality of third positioning holes, and with the plurality of fasteners extending through the plurality of fourth positioning holes.

5. The heat dissipating fan as claimed in claim 4, with the fixed seat including first and second sides spaced along the axial direction, with the through-hole extending from the first side through the second side of the fixed seat, with the first annular lip of the first casing and the stator located on the first side of the fixed seat, and with the second annular lip of the second casing located on the second side of the fixed seat.

6. The heat dissipating fan as claimed in claim 1, with the first outer wall of the first casing or the second outer wall of the second casing tightly fixed to an inner periphery of the through-hole.

7. The heat dissipating fan as claimed in claim 1, with the plurality of connecting members interconnected between the fixed seat and the housing being ribs.

8. The heat dissipating fan as claimed in claim 1, with the plurality of connecting members interconnected between the fixed seat and the housing being stationary vanes.

9. The heat dissipating fan as claimed in claim 1, with the first support and the first outer wall having different diameters to form a shoulder, and with the shoulder including a plurality of heat dissipating holes.

10. The heat dissipating fan as claimed in claim 1, with the second support and the second outer wall having different diameters to form a shoulder, and with the shoulder including a plurality of heat dissipating holes.

11. The heat dissipating fan as claimed in claim 1, with the second casing made of magnetically conductive material.

* * * * *